US006351060B1

(12) United States Patent
Harneit

(10) Patent No.: US 6,351,060 B1
(45) Date of Patent: Feb. 26, 2002

(54) MOISTURE-RESISTANT IGNITER FOR A GAS BURNER

(76) Inventor: Uwe Harneit, 1466 W. Francis St., Ontario, CA (US) 91762-6016

( * ) Notice: Subject to any disclaimer, the term of this patent is extended or adjusted under 35 U.S.C. 154(b) by 0 days.

(21) Appl. No.: 09/361,399

(22) Filed: Jul. 26, 1999

(51) Int. Cl.[7] ..... H01J 1/00

(52) U.S. Cl. ..... 313/326; 313/143; 313/141; 313/118; 431/264

(58) Field of Search ..... 313/143, 141, 313/140, 118, 117, 326, 356, 352, 130; 431/264, 277, 258, 265, 266

(56) References Cited

U.S. PATENT DOCUMENTS

| | | | | |
|---|---|---|---|---|
| D126,466 | S | | 4/1941 | Sibley |
| D141,138 | S | | 5/1945 | Bowes et al. |
| 2,806,518 | A | | 9/1957 | Poole et al. |
| 3,614,280 | A | | 10/1971 | Yamaguchi et al. |
| 4,302,181 | A | | 11/1981 | Schlosser |
| 4,593,340 | A | | 6/1986 | Meyer |
| 4,943,232 | A | | 7/1990 | Lin |
| 5,358,400 | A | | 10/1994 | Ejiri et al. |
| 5,364,264 | A | | 11/1994 | Kwiatek |
| 5,556,272 | A | | 9/1996 | Blasko et al. |
| 5,719,896 | A | * | 2/1998 | Watson ..... 372/86 |

* cited by examiner

*Primary Examiner*—Michael H. Day
*Assistant Examiner*—Joseph Williams
(74) *Attorney, Agent, or Firm*—Lewis M. Brande; Thomas A. McCleary; Brande & McCleary

(57) ABSTRACT

The present invention is an improved igniter assembly for electrical ignition of a gas burner. The improved igniter assembly includes an electrode mantle that has a wavy surface.

5 Claims, 2 Drawing Sheets

MOISTURE-RESISTANT IGNITER FOR A GAS BURNER

BACKGROUND OF THE INVENTION

1. Field of the Invention

A recurrent problem exists in the grill and outdoor cooking industry when an electrode with a cylindric ceramic body is used to create an electric spark to ignite a flammable gaseous mixture. The ceramic body serves as an insulator so that the spark must jump the prescribed gap between the tip of the electrode and the opposite pole. Since the spark seeks the shortest path, it repeatedly occurs that rather than jumping the prescribed gap, when the insulator is damp, the spark jumps back to the mounting location of the electrode. Hence the spark is not even generated. The result is that the gas-air mixture is not ignited and escapes unburned 2. Description of the Prior Art The use of an igniter to ignite a flammable mixture of gas is known in the prior art.

Prior art Pat. No. 5,358,400 discloses a method of installing an igniter plug in a structure defining a combustion chamber. The primary disclosure of this patent is the method of orienting the central electrode and the ground electrode in such a way as to reduce the temperature on the igniter due to the combustion of the air-fuel mixture. This invention specifically discloses a avenue for extending the life span of the ignition plug by reducing the heating of the ground electrode. This is done by orienting the electrode with the use of spacers, which alters the position of the ground electrode as it relates to the air flow of the combustible mixture.

Prior art Pat. No. 4,493,340 discloses an igniter with an improved insulator support. This igniter plug is disclosed for a gas turbine engine. This particular disclosure is made to reduce the expansion variation between two parts of the igniter due to heat of the gap configuration in relatively long igniter plugs. The basic disclosure is for an igniter plug capable of operating in high temperatures by having a metal shell and a ceramic insulator, with means for supporting the insulator near both ends to prevent the exertion of damaging stresses upon the insulator.

Prior art Pat. No. 5,556,272 discloses an improved pilot ignition assembly for a direct fired make-up air heater. The objects of this Patent are to provide an improved ignition assembly that is more resistant to extremely cold outside air temperatures, and additionally is less affected by the humidity of the outside air. The basic disclosure is of having a wind-resisting tubular shroud surrounding the heating element, which provides protection from the incoming cold air.

Prior art Pat. No. 4,302,181 discloses a piezoelectric igniter apparatus for a gas grill. This disclosure is for an igniter that is actuated by a push-button, which in turn extends the electrodes toward the burner assemblies. When the igniter has been extended to its pre-determined length, further pressure on the button causes the generation of an electric spark, which will ignite the gas/air mixture of the gas grill. This invention eliminates long wires, which substantially reduces the deterioration of the insulation about the wires. This invention does not disclose a improved shape for the igniter's insulator.

Prior art Pat. No. 4,943,232 discloses an ignition device for a gas burner. This device contains an electrode that is encased in a collector box that is open on one end. This opening allows gas from a burner to enter where an igniter will generate an electric spark, which in turn will ignite the gas/air mixture. The device disclosed has a means for easily replacing the ignition device without replacing the entire burner unit.

Design Pat. No. 141,138 discloses an ornamental design for a spark plug. This patent shows that the insulator, where the wire would be attached, has a wavy design. In this Patent, the plug is screwed into an orifice, where a common ground is co-incident with the threaded portion of the spark plug. There is no comparable insulator design around the electrode that is similar to the present disclosed invention.

Design Pat. No. 126,466 discloses an ornamental design for a spark plug. This Patent is similar to the previously described design patent, design Pat. No. 141,138, where the insulator has a wavy design. As described in the previous design patent, the plug is screwed into an orifice, where the common ground is co-incident with the threaded portion of the spark plug. There is no comparable insulator design around the electrode that is similar to the present disclosed invention with this design either.

The current invention eliminates the problem of moisture causing the spark to jump back to a conductive ground by modifying the shape of the insulator. In all the prior art patents, the insulator is a simple hollow cylinder that has a smooth exterior. If these patents disclose an insulator that has a different shape than cylindrical, each patent by itself does not specify any particular shape other then the disclosed cylindrical shape. In all these prior art patents, if the igniter is mounted horizontally, as is done in most outdoor barbeque grills, there is a high probability that moisture will condense onto the igniter's cylindrical insulator, which in turn will cause the spark to be grounded on the metallic ground, and not jump the gap to the ground electrode. The insulator design defined by this patent sloughs moisture and prevents this grounding out of the spark due to the moisture adhering to the surface of the insulator.

SUMMARY OF THE INVENTION

The present invention offers a solution to the problem as described above under Field of the Invention.. In accordance with the present invention, the cylindrical form of the outer mantle form of the ceramic body that serves as an insulator is changed to a wavy external shape. This external shape could also be a fluted external shape.

Moisture collects on the peaks of the waves or on the greater diameters of the ceramic body and would drop off from these areas.

If the mantle of the ceramic body of the electrode is as described, either wavy or fluted, the spark does not simply jump over the valleys of the waves or flutes, nor does it travel in a wavy line over the surface of the insulator back to the mounting location of the electrode, but since it seeks the shortest path, it jumps the prescribed spark gap and in so doing ignites the gas-air mixture flowing through the gap.

DETAILED DESCRIPTION

Figure 1:
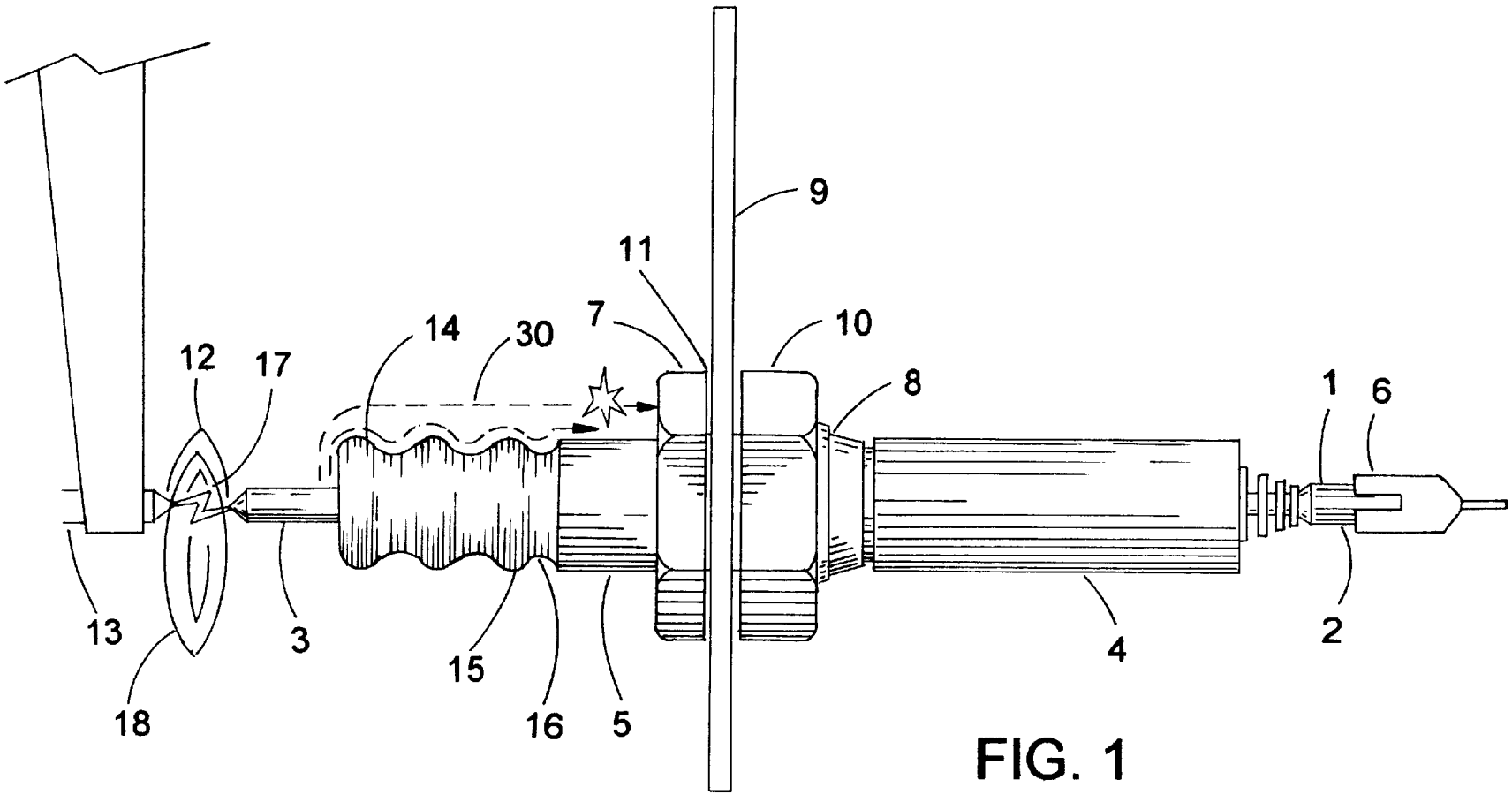
FIG. 1 shows the present invention installed in a horizontal position, the insulating electrode mantle having a wavy surface.

FIG. 1 illustrates an igniter, of common design, incorporating an improved insulating electrode mantle.

The igniter has an electrode (1) with an external end (2) and an internal end (3). The electrode (1) penetrates essentially centrally through an external insulator (4) and an internal ceramic mantle (5). The external end (2)of the electrode (1) is exposed and provides a means to connect a wire (6) to provide electrical current to the electrode (1). A hollow stud (7) is fixed to the internal ceramic mantle (5) and provides an externally threaded surface (8) that penetrates through a mounting surface (9). An internally threaded nut (10) is threaded onto the externally threaded surface (8) of the hollow stud (7) and locks the igniter into its desired mounting position (11). The internal end (3) of the electrode (1) penetrates through the internal ceramic mantle (5) and is positioned as to define a gap (12) between the internal end (3) of the electrode (1) and a ground electrode (13). The internal ceramic mantle (5) has a wavy surface (14) that is defined by a series of peaks (15) and valleys (16). When the igniter is in use, a normal spark (17) is generated between the internal end (3) of the electrode (1) and the ground electrode (13) igniting a gas-air mixture to create a flame (18). On a non wavy internal ceramic mantle, moisture will condense on the surface and allow a spark to travel along the moist surface of the internal ceramic mantle along a path (30) and ground out at a hollow stud. The novelty of this invention lies in the fact that when the wavy surface (14) is wet with moisture current would have a longer path to the mounting position (11) along the internal ceramic mantle (5) due to the wavy surface (14), or else it would have to jump across the valleys (16). In either case the current would have to overcome a greater resistance before shorting out.

The shape of the peaks and valleys can vary depending on which configuration the manufacturer desires. The following examples are illustrative, but are not meant to be limiting.

Figure 2:
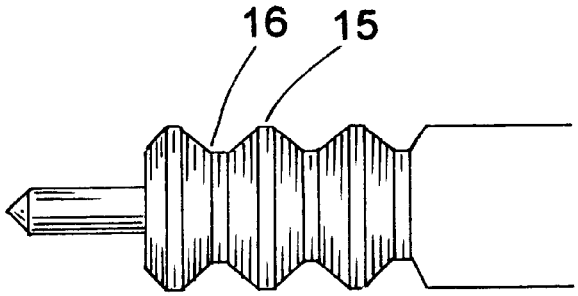
FIG. 2 shows the insulating electrode mantle having trapezoidal-shaped surface
Figure 3:
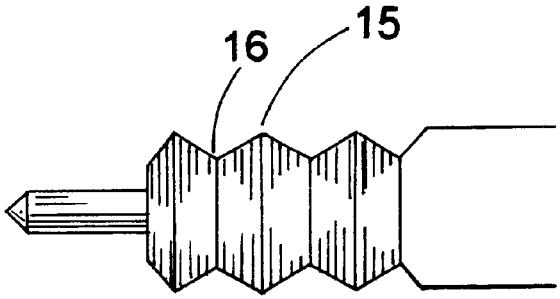
FIG. 3 shows the insulating electrode mantle having triangular-shaped surface.
Figure 4:
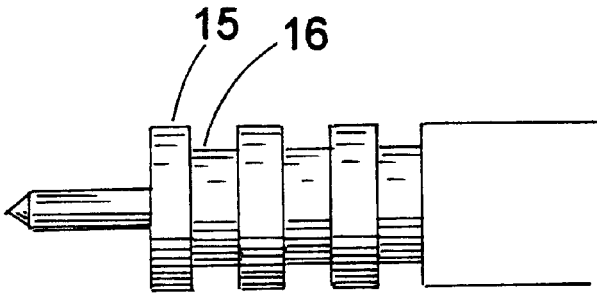
FIG. 4 shows the insulating electrode mantle having right angle shaped waves

FIG. 2 represents an internal ceramic mantle where the wavy surface is defined by a series of trapezoidal shapes. FIG. 3 represents an internal ceramic mantle where the wavy surface is defined by a series of triangular shapes. FIG. 4 represents an internal ceramic mantle where the wavy surface is defined by a series of rectangular shapes.

Although the foregoing includes a description of the best mode contemplated for carying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. An igniter having an electrode, said electrode penetrating an electrode mantle, said electrode mantle having a contiguous surface defined along a longitudinal axis by a multiplicity of peaks and a multiplicity of valleys, said multiplicity of peaks and valleys having a convex shape and said multiplicity of valleys having a concave shape, with an internal end of said electrode penetrating said electrode mantle, said internal end of said electrode positioned to create a gap between said internal end of said electrode and a ground electrode, whereby a spark is generated when said igniter is in use, said spark igniting an air-fuel mixture to create a flame for cooking food.

2. An igniter as set forth in claim 1, wherein said multiplicity of peaks and said multiplicity of valleys of said electrode mantle, have a trapezoidal shape.

3. An igniter as set forth in claim 1, wherein said multiplicity of peaks and said multiplicity of valleys of said electrode mantle, have a triangular shape.

4. An igniter as set forth in claim 1, wherein said multiplicity of peaks and said multiplicity of valleys of said electrode mantle, have a rectangular shape.

5. An igniter as set forth in claim 1, wherein said multiplicity of peaks and said multiplicity of valleys of said electrode mantle, have a sinusoidal shape.

* * * * *